US006997800B1

(12) United States Patent
Kohler

(10) Patent No.: US 6,997,800 B1
(45) Date of Patent: Feb. 14, 2006

(54) ROOF VENT SYSTEM

(76) Inventor: Raymond L. Kohler, 2509 E. Fairview Cir., Mesa, AZ (US) 85204

( * ) Notice: Subject to any disclaimer, the term of this patent is extended or adjusted under 35 U.S.C. 154(b) by 19 days.

(21) Appl. No.: 10/752,361

(22) Filed: Jan. 5, 2004

(51) Int. Cl.
*F24F 13/08* (2006.01)

(52) U.S. Cl. ..... 454/365; 52/198

(58) Field of Classification Search ..... 454/364, 454/365, 366; 52/198, 199
See application file for complete search history.

(56) References Cited

U.S. PATENT DOCUMENTS

| | | | | |
|---|---|---|---|---|
| 3,949,657 | A | 4/1976 | Sells | |
| 4,325,290 | A | 4/1982 | Wolfert | |
| 4,545,291 | A | 10/1985 | Kutsch et al. | |
| 4,558,637 | A | 12/1985 | Mason | |
| 4,573,291 | A | 3/1986 | Hofmann | |
| 5,326,318 | A * | 7/1994 | Rotter | 454/365 |
| 5,339,582 | A * | 8/1994 | Sells | 52/198 |
| 5,697,842 | A * | 12/1997 | Donnelly | 454/365 |
| 5,797,222 | A * | 8/1998 | Martin | 52/198 |
| 5,803,805 | A * | 9/1998 | Sells | 454/364 |
| 5,924,925 | A * | 7/1999 | Nystrom | 454/365 |
| 6,128,870 | A | 10/2000 | Kohler | |
| 6,185,880 | B1 * | 2/2001 | Richardson | 52/198 |
| 6,371,847 | B1 * | 4/2002 | Headrick | 454/365 |
| 6,537,147 | B1 * | 3/2003 | Smith | 454/365 |
| 6,598,353 | B1 * | 7/2003 | Reeves | 52/57 |
| 6,662,509 | B1 * | 12/2003 | Sharp et al. | 52/199 |

* cited by examiner

*Primary Examiner*—Derek S. Boles
(74) *Attorney, Agent, or Firm*—Gregory J. Nelson

(57) ABSTRACT

A roof ventilation system including a prefabricated ridge vent assembly with sidewalls secured at spacers. The spacers support a top cap spaced above the sidewalls which defines a net free ventilation area. The ventilation area is screened. The ridge vent assembly is maintained by mounting blocks which are secured to the ridge vent by connectors such as 2"×4" lumber sections. The system may also utilize eave vent assemblies having a screened ventilation area. The eave vent assembly has a lip to support a trim piece such as a fascia board.

10 Claims, 5 Drawing Sheets

ROOF VENT SYSTEM

FIELD OF THE INVENTION

The present invention relates to a roof vent system and more particularly to a roof vent system which may be installed at the ridge along the peak of a building roof and below the eave line to allow air to vent or escape from enclosed attic or rafter spaces.

BACKGROUND OF THE INVENTION

Many types of roof ventilators for venting attic or rafter spaces are found in the prior art. Some are of the turbine type which are wind-driven. Evacuation of attic space area may also be accomplished by fans which are generally mounted on the roof and which may be thermostatically controlled to exhaust hot air.

Other types of roof ventilators are static venting devices mounted over the elongated opening along the roof ridge of a building. In most cases, these vents comprise a sheet metal structure having air passageways or perforations.

Representative of these type of ventilation devices are shown in U.S. Pat. No. 4,545,291 which discloses a ventilator comprised of sheet metal having the inner baffle and flue portions in an outer storm band casing. Louvers are provided in the base and baffle portions of the sidewall.

U.S. Pat. No. 3,949,657 shows a ventilated cap which may be placed over the opening in the ridge of the roof which has a pair of beveled edge vent parts. Each vent part has transversely oriented openings extending from one beveled edge to the other. These vent parts are placed side-edge to -side-edge over the opening in the roof ridge and secured to the underlying roof surfaces.

U.S. Pat. No. 4,558,637 discloses a ventilating member having a central inverted V-shaped portion connecting the sides. Louvers and shield portions are located adjacent to side louvers to prevent precipitation from passing through the support member and down into the ridge roof openings.

U.S. Pat. No. 4,573,291 discloses a ridge covering having flexible sealing strips arranged between the covering caps fastened to the ridge or hip board and the roofing tiles.

U.S. Pat. No. 4,325,290 shows a ridge ventilator for the roof of a building which includes porous, non-woven and fiberous filter media selectively installed in the ventilator to prevent infiltration of moisture through the ventilator into the space below the roof.

One roof vent system which has been commercially utilized is shown in U.S. Pat. No. 5,339,582 and sold under the designation "Cor-A-Vent." This patent shows an air dam mounted on a vent having openings extending transversely. The air dam includes an outer and upper flange and a lower leg with the outer edge of the flange being spaced from the inner surface of a covering over the roof ridge to insure proper air flow from the roof peak and to form a barrier against the ingress of wind-driven moisture into the vent openings.

My prior patent, U.S. Pat. No. 6,128,870, discloses a roof vent system having sidewalls which are secured in spaced-apart relationship by flashing sections to the roof ridge. Spacers are provided at spaced-apart locations along the sidewalls. The spacers may be extruded, square tubular sections, Z-section or other configurations. A screen extends between the sidewalls. A roof cap has a web which is held in place between the fasteners. The roof cap has flanges at its upper end which support a roof member such as a tile in an elevated position above the ridge to provide sufficient venting.

The requirements for ventilation of attics and rafter spaces set forth various building codes such as the International Residential Code. Generally, these codes prescribe a minimum total net-free ventilating area which generally is established to not be less than 1/150th of the area of the space ventilated except that the total area is permitted to be reduced to 1/300 providing at least 50%, and not more than 80%, of the required ventilating area is provided by the ventilators located in the upper portion of the space. The net free cross ventilation area may also be reduced when a vapor barrier having a transmission rate not exceeding an established rate is installed on the warm side of the ceiling.

While systems such as that shown in my prior patent have experienced commercial success, there nevertheless exists a need for a simple, easy to install roof vent system which will comply with building codes and which is adaptable to various installation applications.

BRIEF SUMMARY OF THE INVENTION

Briefly, the present invention provides a roof vent system which may be utilized to provide the net free ventilation area required under various residential codes. The roof vent system is prefabricated and may be secured at the roof ridge or below an overhanging eave. The roof ridge vent system has a pair of spaced-apart sidewalls which at their upper end have an angularly disposed moisture deflecting flange. Vent screens extend upwardly from the upper edges of the sidewalls. Spacers enclose the vent at locations spaced inwardly from the ends of the sidewalls. A top cap extends the length of the sidewalls across the top of the vent screens so that a vent space is defined between the upper edge of the sidewall and the top cap. The vent area is protected by the screen. Mounting brackets may be positioned on the ridge adjacent the ends of the vent so that a mounting block, such as a section of 2"×4" lumber, supported by the bracket may extend into the ends of the ridge vent assembly to allow the installer to vertically position and adjust the vent. The lower edges of the vent sidewalls are preferably attached to a flexible flashing member which extends onto the roof and will be normally covered with roofing tile or other roofing material. The roof ridge vent described above may be used with various types of roofing such as metal roofs or roofing tiles having "M" or "S" configurations or a flat profile.

The eave vent assembly has a rear sidewall securable in a vertical position below the eave. A second sidewall is horizontally spaced from the rear sidewall and a screened vent area is defined between the sidewalls. The sidewalls are held in spaced-apart relationship by spacers. A lip is provided on the outer wall so a finish board may be positioned having its lower edge on the lip or flange and secured in place extending to the roof eave structure.

BRIEF DESCRIPTION OF THE DRAWINGS

The above and other objects and advantages of the present invention will become more apparent from the following description, claims and drawings in which:

DETAILED DESCRIPTION OF THE DRAWINGS

Figure 5:
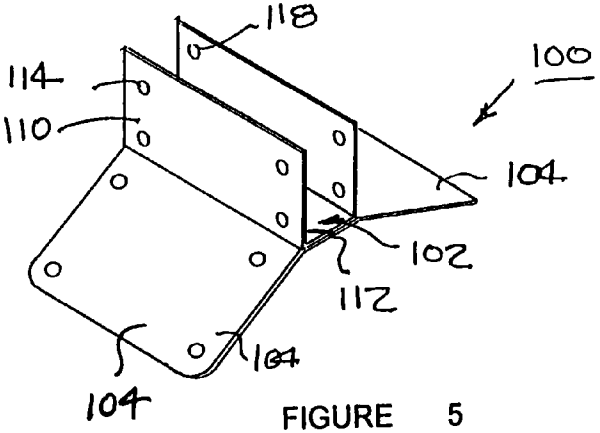
FIG. 5 is a perspective view of the mounting bracket used to install the ridge vent assembly of the present invention.

Turning now to the drawings, particularly FIGS. 1 through 7, an embodiment of the roof ridge vent assembly of the present invention is shown and is generally designated by the numeral 10.

The roof vent assembly 10 includes a pair of spaced-apart sidewalls 12 and 14. Each of the sidewalls are shown as being generally elongate having opposite vertical ends 20, 22, lower horizontal edge 24 and upper horizontal edge 26. An angular flange 28 extends downwardly and outwardly from the upper edge 26 of sidewalls 12 and 14 and will provide stiffening and will also serve to deflect moisture away from the vent space opening "O." The sidewalls 12, 14 may be fabricated from a suitable material such as a galvanized sheet metal formed in a suitable bending or stamping process.

A panel of flexible flashing material 30 is secured along the lower edge 24 of the sidewalls. The sidewalls 12, 14 may be double thickness and the flashing 30 sandwiched between the walls to secure it in place. The flexible flashing material may be a roof felt or other weather resistant materials such as that sold under the trademark Tyvek®.

Figure 6:
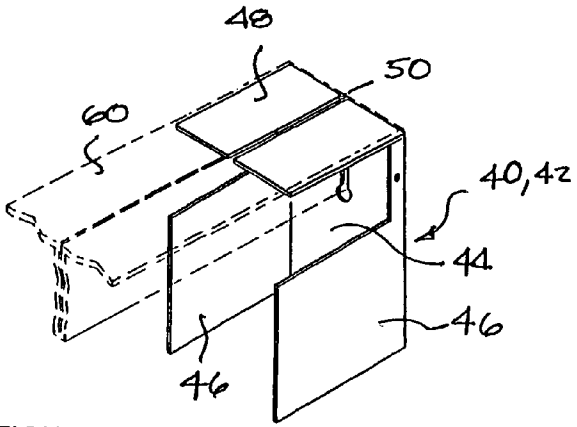
FIG. 6 is a perspective view of a spacer with the top cap shown in dotted lines.
Figure 2:
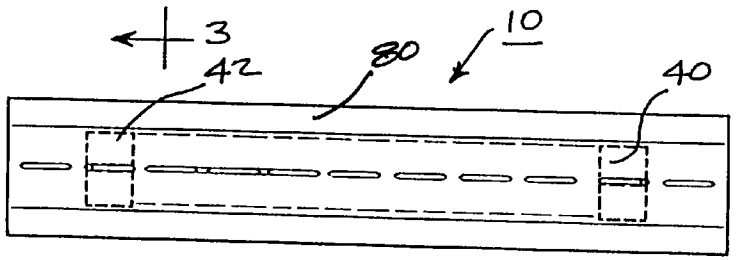
FIG. 2 is a top view of a section of the ridge vent assembly.

Spacers 40, 42, as shown in detail in FIG. 6, extend transversely between the sidewalls 12, 14 at spaced-apart locations. Typically the length of one entire vent assembly would be, for example, 5 feet. The spacers 40, 42 are positioned at a location inwardly from the end walls 20, 22, typically a distance of approximately 6", as seen in FIG. 2. The spacers 40, 42 are identical, as seen in FIG. 6, and each have a transverse end section 44 and integrally formed side flanges 46 which are bent at right angles with respect to end 44. The spacers 40, 42 are secured to the sidewalls 12, 14 by a suitable fastening operation such as by screws, clinching or spot-welding. The upper edges of the spacers are also bent to form a horizontal lip or flange at 48. A vertical slot 50 is defined in each of the flanges 48 at a central location and extends downwardly in wall 44 to receive "T" section 60.

Figure 3:
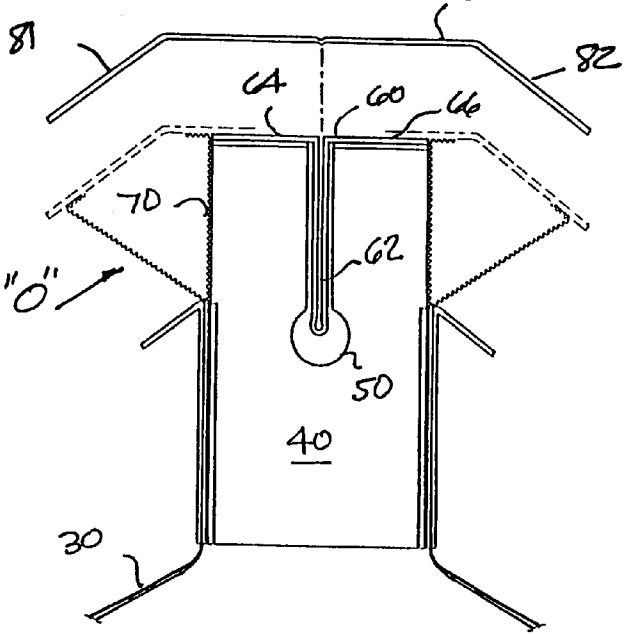
FIG. 3 is a cross-sectional view taken along line 3—3 of FIG. 2.
Figure 4:
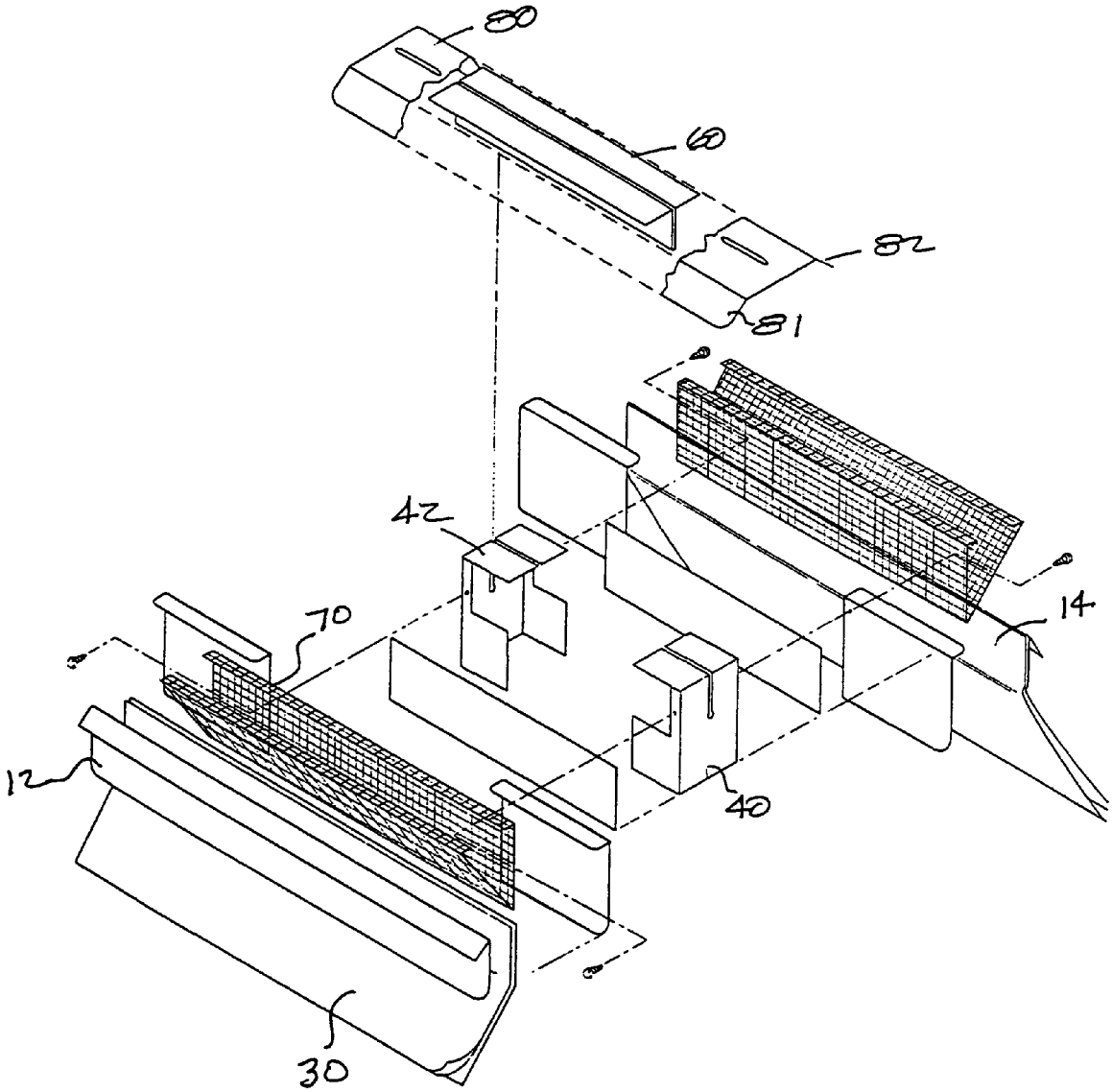
FIG. 4 is an exploded view of the ridge vent assembly as shown in FIG. 1.
Figure 7:
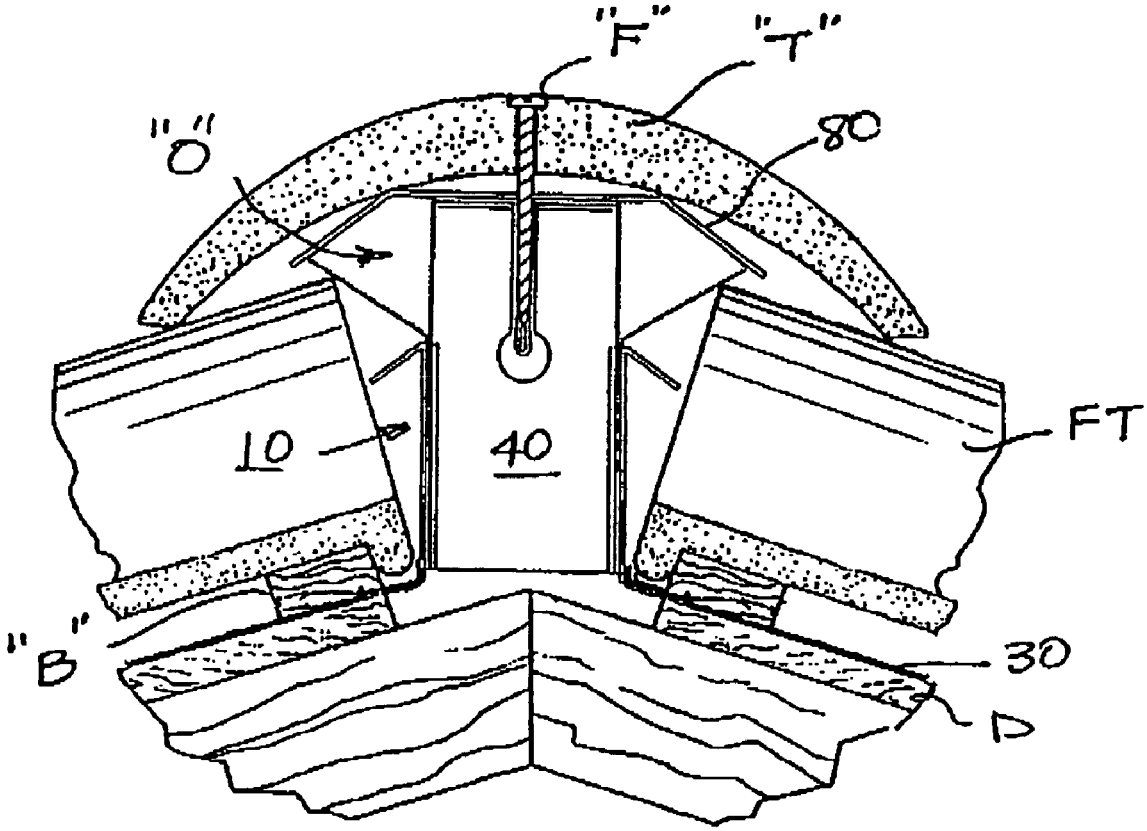
FIG. 7 is a cross-sectional view showing installation on a tile roof in which the vent is capped with a roof tile.

As seen in FIGS. 3, 4 and 7, a top cap 80 includes a separate "T" section 60 which includes a web 62 and opposite flanges 64, 66 at the upper end of the web. The top cap 80 has sections 81, 82 which extend outwardly and downwardly past the sidewalls to deflect moisture. The "T" section 60 can be fabricated from a single piece of material such as sheet metal and formed by a bending operation into the shape shown in FIG. 3 with the web 62 being double wall thickness or the flange and web may separate sections joined together. The top cap 80 is secured to the "T" section 60 by clinching.

The top cap 80 has an overall length that corresponds to the length of the sidewalls 12, 14. The web section 62 of the "T" section 60 is inserted into the slots 50 in the spacers 40, 42 and the top is secured in place by securing the "T" section 60 to the horizontal flanges 48 of the spacers 40, 42 by clinching, spot welding or other conventional joining methods.

The completed ridge roof vent assembly 10 is provided to the roofing contractor in sections having an overall length L. The length L may be any suitable length but, as mentioned above, for most installation will normally be approximately 5 feet in length. The vent assembly 10 is installed on the roof by placing the flexible flashing sections 30 over the roofing paper and the roof decking. The flexible flashing sections will provide a water-tight installation once the roofing is completed by installation of metal roofing or roofing tiles or shingles. The user will calculate the required number of roof vents in accordance with the appropriate building codes using formulas as described above in the background of the invention to obtain the required vent area.

It will be noticed that the vent areas "O" between the flanges of the top cap 80 and the sidewalls 12, 14 are enclosed by screen 70 extending along the sides of the roof vent and the ends below. The screen, typically ⅛" to 3/16" diamond mesh, serves to keep insects from entering into the attic or rafter space. The vent assembly provides ventilation of the attic or crawl space with little restriction to air flow. The screen 70 may also extend angularly from flanges 80, 81 as seen in FIG. 3.

The vent assembly 10 is installed on the roof by placing the flexible flashing sections on the deck D over the roofing paper. Roofing paper should be used to cover the plywood deck. As mentioned above, the interior spacers 40, 42 of the vent assembly are positioned inwardly from the end of the sidewalls 12, 14, typically about 6". Once the roof vent assembly has been placed in position, battens B may be placed across the deck and flashing 30 at spaced-apart intervals, as seen in FIG. 7.

Figure 1:
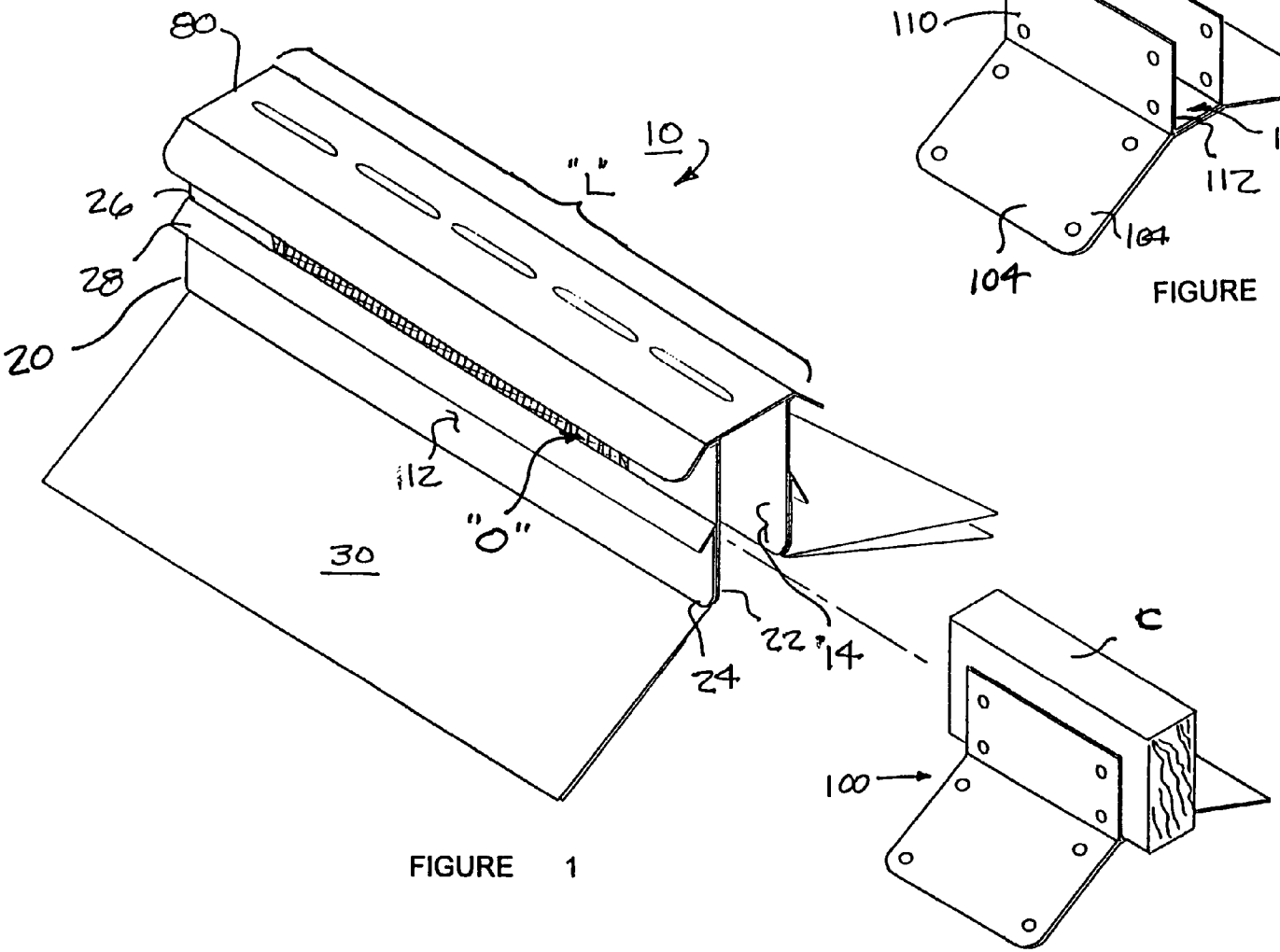
FIG. 1 is a perspective view of the ridge vent assembly according to the present invention.

The roof vents are secured in place by attaching connection blocks "C" shown in FIGS. 1 and 5, in mounting members 100. The mounting members 100 each consist of a base plate 102 having opposite flanges 104 which project downwardly and are provided having an angular orientation corresponding to the pitch of the roof or may be manually adjusted by bending at the time of installation. The planar section between the depending flanges 104 supports a generally U-shaped bracket 110. The U-shaped bracket 110 has a base 112 and opposite upstanding flanges 114. Preferably the bracket is sized to accommodate a vertically oriented 2"×4" connector "C" as seen in FIG. 1. The connector "C" is a connector and is inserted into the bracket 110 and secured in place by nails or screws through nailing holes 118. The projecting end of the connector "C" is inserted between the side plates 12, 14 of the adjacent roof vent assembly. The position of the roof vent assembly can be vertically adjusted relatively to the ridge and secured to the connector "C" by selectively positioning the fasteners inserted through nailing holes 118 relative to the connector block 100.

Once the roof vent assembly is in place and positioned and the battens "B" have been placed across the deck D, as described above, tile sections "FT" can be applied over the battens "B." The tile may have an "S" tile, "M" tile or flat tile profile or the covering may be metal roofing sections. The mounting bracket permits height adjustment at the time of installation to accommodate different roofing materials. The air flow is accommodated from the attic space upwardly through the roof vent assembly as shown by the arrows. The air space "O" defined by the area of the screen is defined as the net free air space. As indicated, one or more roof vents will be provided at selected locations to provide the necessary net free air space.

In order to complete the structure and provide an aesthetically pleasing appearance. A roof tile "T" is normally placed over the top cap 80 and secured in place by a fastener "F" extending into the web of "T" section 60 as seen in FIG. 7. Alternatively, the top cap 80 may simply be painted or finished to match the color and decor of the roof.

Figure 8:
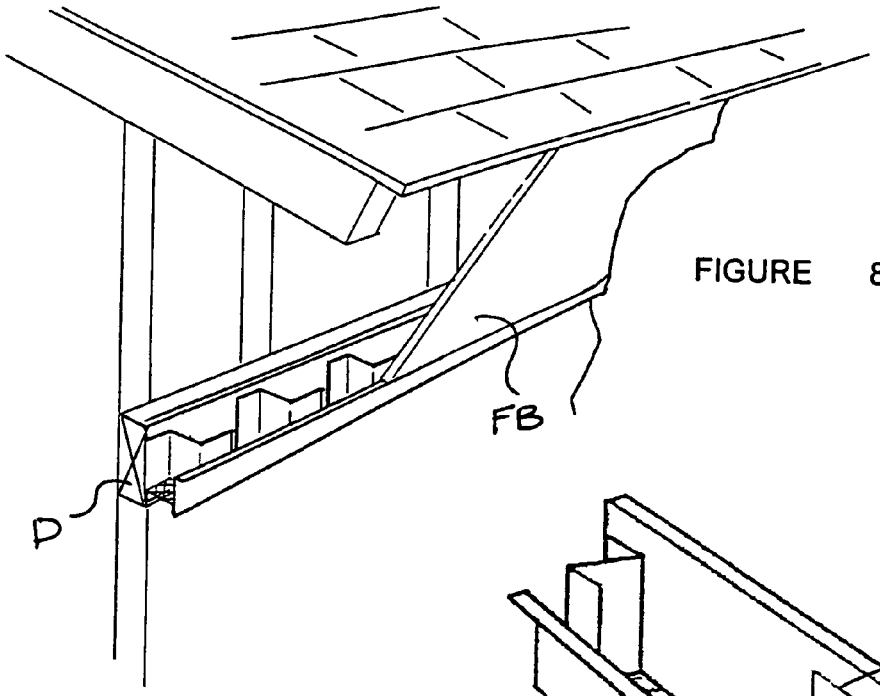
FIG. 8 is a perspective view showing an eave vent assembly according to the present invention installed in position along the eave of a building.
Figure 9:
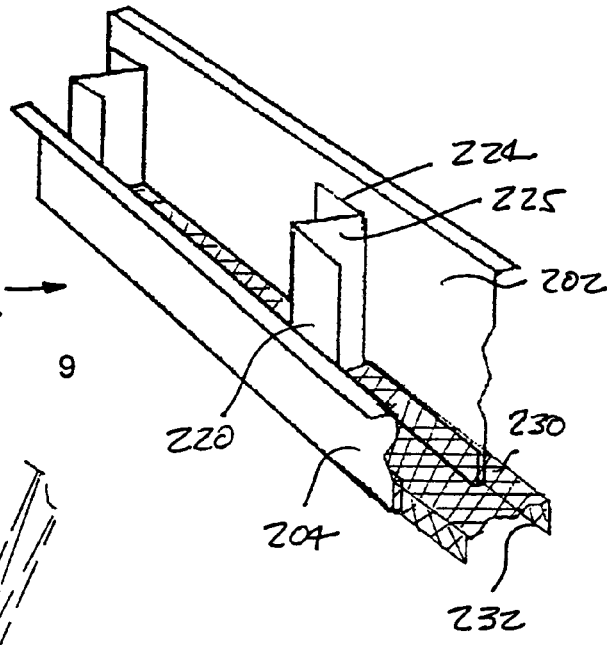
FIG. 9 is a perspective view showing the eave vent of FIG. 8.
Figure 10:
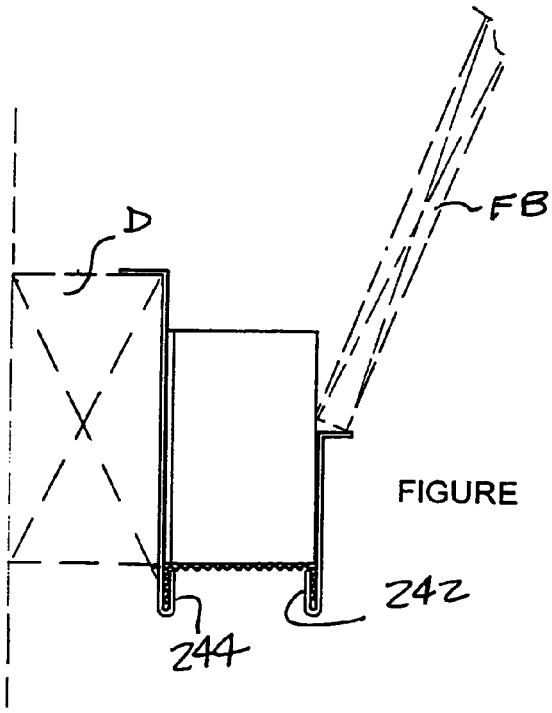
FIG. 10 is a cross-sectional view taken along line 8—8 of FIG. 8.

In addition to installation of roof ridge vents for ventilation and moisture control, eave vents may also be installed to provide additional ventilation or cross ventilation between the eaves and the roof vents. Referring now to FIGS. 8 to 10, an eave vent assembly is generally designated by the numeral 200 and may be fabricated from sheet metal by conventional metal stamping, bending or joining operations. The eave vent has a back wall 202 and a spaced-apart front wall 204 of lesser height. The back wall 202 preferably has a height corresponding to, or greater than, the vertical height of a framing member such as a 2"×4" or 2"×6", as seen in FIG. 10. The upper edge of the back wall is bent forming a horizontal lip 206 which can be positioned over the edge of a horizontally extending structural member such as a framing member as seen in FIG. 10. Eave assemblies 200 can be provided in any desired length and may be installed in abutting and end-to-end relationship to extend the entire distance along a wall structure.

The front wall 204 is spaced from the back wall 202 and has a height less than the rear wall and the front wall has a forwardly extending lip 208. The distance between the front and rear wall corresponds to the dimensional width of a 2"×4" or 2"×6" approximately 1⅝". The front and rear walls are maintained in this relationship by spaced-apart spacers 220 which are shown as Z sections having front and rear flanges 222, 224 connected by web 225 which are secured to the walls by clinching or other mechanical securing techniques. A metal screen 230 extends between the front and side walls. The screen is bent in a generally U-shape and has depending sections 232 which are secured between the reversely bent lower edges 242, 244 of the walls 204, 202.

When the eave vent assembly is installed, as shown in FIGS. 8 and 10, it is nailed to an exterior framing member "D." Multiple eave assembly sections can be provided so that the required net free air space is available. A finish board "FB" can be cut to size and positioned between the forwardly extending lip 208 on the front wall and a framing member such as a roof fascia board. With the finish board in place, the structure can be completed in conventional manner by application of a moisture barrier and an exterior surface and treatment such as stucco. The eave vent assemblies can be painted to match the color and decor of the wall and the forwardly extending lip will support the panel extending to the finish board will also provide location for placement of finish materials such as wire mesh, lathe, foam board and stucco. Thus, in the completed structure, the eave vent will be obscured, blending into the overall appearance of the completed structure.

It will be obvious to those skilled in the art to make various changes, alterations and modifications to the invention described herein. To the extent such changes, alterations and modifications do not depart from the spirit and scope of the appended claims, they are intended to be encompassed therein.

I claim:

1. A vent assembly mountable along the ridge of a roof having a ridge opening, said vent assembly comprising:

(a) a vent having spaced-apart sidewalls each having a top, bottom and opposite ends;

(b) spacers between the sidewalls, said spacers being positioned inward of each of the opposite ends of said sidewalls;

(c) a top cap having a top flange and a web, said web secured to said spacers to position said flange above said top edge of said sidewalls to define a ventilation area therebetween;

(d) a mounting bracket having a flange securable to said roof adjacent the ends of said vent and connector means securable to said bracket and vent whereby the position of said vent relative to said roof may be selectively adjusted at installation; and (e) flexible flashing attached to the bottom of said sidewalls.

2. The vent assembly of claim 1 wherein said ventilation area is screened.

3. The vent assembly of claim 1 wherein said spacer defines slots to receive the web of said top cap.

4. The vent assembly of claim 1 wherein said upper edge of said vent sidewalls each have an angularly disposed moisture deflecting flange.

5. The vent assembly of claim 1 wherein said vent is prefabricated in predetermined lengths.

6. The vent assembly of claim 1 wherein said vent is fabricated from sheet metal.

7. The vent assembly of claim 1 wherein said spacers each define a slot and wherein said top cap has a downwardly depending flange engageable in said slots.

8. A method of providing ventilation to a roof structure having a ridge opening comprising:

(a) providing a vent including:

(i) spaced-apart sidewalls each having a top, bottom and opposite ends;

(ii) a spacer positioned between the vent sidewalls, inward of the opposite ends of said sidewalls;

(iii) a top cap having a top flange and a web, said web secured to said spacers to position said flange above said top edge of said sidewalls to define a ventilation area therebetween; and (iv) flexible flashing extending from said bottom of said sidewalls:

(b) positioning mounting brackets at predetermined locations along said ridge opening;

(c) inserting a connector between said vent and said brackets;

(d) adjusting the positioning of said vent relative to the roof;

(e) securing said vent to said connector; and (f) securing said flexible flashing to said roof structure.

9. The method of claim 8 further including securing a section of trim material to said top cap.

10. The method of claim 9 wherein said trim material is tile and is secured by inserting a fastener through said tile into said web.

* * * * *